United States Patent [19]

Rapier

[11] 4,326,581

[45] Apr. 27, 1982

[54] DIRECT CONTACT, BINARY FLUID GEOTHERMAL BOILER

[75] Inventor: Pascal M. Rapier, Richmond, Calif.

[73] Assignee: The United States of America as represented by the United States Department of Energy, Washington, D.C.

[21] Appl. No.: 107,791

[22] Filed: Dec. 27, 1979

[51] Int. Cl.[3] ..... F28D 21/00

[52] U.S. Cl. ..... 165/45; 60/641.3; 122/31 R; 165/111; 165/114

[58] Field of Search ..... 122/28, 40, 31 R; 60/641 D; 165/111, 45, 114, 110; 261/118

[56] References Cited

U.S. PATENT DOCUMENTS

| | | | |
|---|---|---|---|
| 2,561,471 | 7/1951 | Hatfield | 122/31 R |
| 3,164,957 | 1/1965 | Fricke | 60/649 X |
| 3,227,649 | 1/1966 | Ghormley et al. | 165/111 |
| 3,988,895 | 11/1976 | Sheinbaum | 60/641 |
| 4,057,964 | 11/1977 | Hutchison | 60/641 |
| 4,063,418 | 12/1977 | Shields | 60/641 |
| 4,084,379 | 4/1978 | Schwartzman | 60/641 D |
| 4,089,175 | 5/1978 | Woinsky | 60/641 |
| 4,144,715 | 3/1979 | Fleck et al. | 60/641 |

*Primary Examiner*—Allen M. Ostrager
*Assistant Examiner*—Stephen F. Husar
*Attorney, Agent, or Firm*—L. E. Carnahan; Roger S. Gaither; Richard G. Besha

[57] ABSTRACT

Energy is extracted from geothermal brines by direct contact with a working fluid such as isobutane which is immiscible with the brine in a geothermal boiler. The geothermal boiler provides a distributor arrangement which efficiently contacts geothermal brine with the isobutane in order to prevent the entrainment of geothermal brine in the isobutane vapor which is directed to a turbine. Accordingly the problem of brine carryover through the turbine causes corrosion and scaling thereof is eliminated. Additionally the heat exchanger includes straightening vanes for preventing startup and other temporary fluctuations in the transitional zone of the boiler from causing brine carryover into the turbine. Also a screen is provided in the heat exchanger to coalesce the working fluid and to assist in defining the location of the transitional zone where the geothermal brine and the isobutane are initially mixed.

31 Claims, 13 Drawing Figures

DIRECT CONTACT, BINARY FLUID GEOTHERMAL BOILER

BACKGROUND OF THE INVENTION

The invention described herein arose under work at Lawrence Berkeley Laboratory in the course of, or under, contract W-7405-ENG-48 between the U.S. Department of Energy (formerly Energy Research and Development Administration) and the University of California.

This invention relates to direct contact, binary fluid geothermal boilers and in particular to boilers which provide for heat transfer to a working fluid by direct contact with a geothermal brine.

BACKGROUND ART

A developing source of energy is subterranean water sources which are heated by the earth's magma and which are otherwise known as geothermal brines. One way of extracting energy from geothermal brines is to transfer heat from the geothermal brine directly to a working fluid by means of a heat exchanger. The working fluid is used to produce work as, for example, when it expands through a turbine. Thus, corrosion and scale deposits on turbine blades and other turbine components, which are powered by the working fluid, is avoided as the geothermal brines, which usually contain dissolved solids, are not used directly therein.

One type of heat exchanger, the flash-type evaporator direct contact, binary fluid geothermal heat exchanger or boiler operates by the direct contact between two immiscible fluids, one being the geothermal brine, and the other being a working fluid such as, for example, isobutane. In the flash-type heat exchanger a liquid or mixture of liquids which serves as the working fluid is initially pressurized to prevent boiling and is heated to a temperature above its saturated temperature at the desired final pressure. When the over pressure is relieved a equilibrium portion of the liquid flashes into vapor.

Several problems are associated with the direct contact, binary fluid geothermal heat exchangers. One of these problems is the efficiency of heat transfer between the geothermal brine and the working fluid. The heat transfer co-efficient for a prior art heat exchanger 20 as depicted in FIG. 1 is unnecessarily reduced due to the particular apparatus which is used to introduce the liquid brine into the liquid working fluid, which in this case can be isobutane. As can be seen in FIG. 1, the working fluid enters the lower portion of the heat exchanger through a port 22 and is provided through distributor 24 in the form of droplets 25. The geothermal brines are introduced through port 26 and directed to distributor 28. As the isobutane has a specific density which is less than the geothermal brines, and as the isobutane is immiscible with the geothermal brines, the droplets of isobutane flowed upwardly in the geothermal brines. Due to the flow rate and other factors which will be discussed hereinbelow, the level of the mixture of geothermal brines and isobutane, in both liquid and gaseous phases, is determined and is indicated at 30. Immediately above the top of this brine-continuous zone (wherein isobutane is distributed in the brine) is a transitional zone which essentially divides the liquid and gaseous mixtures of geothermal brines and isobutane from a vaporous-continuous zone which exists thereabove in area 32. The transitional zone which is indicated at 34 is comprised of a foaming, frothing and boiling area of liquid and gaseous geothermal brines and isobutane.

As can be seen in FIG. 1 distributor 28 extends well below this transitional zone 34. Accordingly, liquid geothermal brines are introduced directly into contact with liquid isobutane through ports 36. Such liquid-liquid contact offers great resistance to heat transfer and thus has a low heat transfer coefficient. The reason for this low heat transfer coefficient can be seen more clearly in FIG. 1A. As the brine is introduced into the isobutane, the isobutane immediately adjacent thereto vaporizes and forms an isobutane, vaporous blanket 38 about a droplet of liquid isobutane 40. Consequently the only area where good heat transfer can occur is where the isobutane droplet 40 contacts the surface of the isobutane blanket 38 at point 42, the lowest point thereof. Stated alternatively, frothing is produced when the isobutane is vaporized beneath level 30 by the hot brines, forming a metastable cellular structure of isobutane bubbles in the brines whereby heat transfer to the isobutane droplets inside the bubbles is stiffled by the low conductivity of the isobutane gas blanket. The isobutane droplet and the accompanying blanket 38 must rise to level 30, before the blanket is disbursed and the droplet vaporized. Accordingly below level 30 only a preheat zone exists, and not an efficient isobutane vaporization or flash zone with a high heat transfer coefficient.

Because of the submerged introduction of the geothermal brines in the liquid isobutane, and the associated flashing of the isobutane there is a considerable amount of back-mixing beneath the level 30. This back-mixing can propagate wave fronts vertically in the heat exchanger 20 with resultant instabilities and level surges in the operation thereof and in particular in the size and location of transition zone 34 and the position of level 30. Such instability in the level 30 can cause froth which includes liquid and vaporous geothermal brine to carry over through isobutane outlet port 44 and into the turbine, causing scaling and corrosion of said turbine. A demister 46 placed at the upper end of gaseous area 32 will generally not be adequate enough to stop the brine mist from entering the turbine.

Another problem with the present heat exchanger 20 is that in order to increase the capacity of a system using exchanger 20 a plurality of such exchangers would have to be incorporated into the system as increasing the size of boiler 20 beyond a certain range would not produce a proportional increase in the transfer of heat to the isobutane.

In another type of prior art heat exchanger 50 is depicted in FIG. 2. Elements in boiler 50 which are similar to those in the boiler 20 of FIG. 1 are identified with similar numerals, which have been primed. Boiler 50 differs from boiler 20 in that the geothermal brine distributor 52 includes a distributor head 54 which has a plurality of ports for allowing the geothermal brines to rain down upon level 30' and zone 34'. The brine, besides causing the isobutane to flash to vapor upon direct contact therewith, also itself flashes to vapor and atomizes as it leaves the distributor head 54. Consequently there is a mixture of brine and isobutane vapors in gaseous area 32' and accordingly, excessive brine vapor and mist carry-over through outlet port 44' into the turbine even with the addition of demister 46'.

The uncontrolled flashing instabilities and surges throughout the heat exchangers of FIGS. 1 and 2 also promote loss of isobutane from the bottom of the boiler through brine outlet ports 48 and 48'.

Accordingly it is an object of the present invention to provide a controlled means for boiling a working fluid for extraction of geothermal energy by direct contact with hot, pressurized geothermal brines.

Another object is to provide direct contact between the geothermal brines and the working fluid in such a manner as to provide a controllable amount of superheat in the working fluid vapor, so that the boiling of the two immiscible fluids can be made to occur very close to equilibrium conditions as predicted by the Gibbs Phase Rule.

Another objective of the present invention is to provide for direct contacting of the geothermal brine and the working fluids so as to minimize entrainment of the liquid geothermal brines in the isobutane vapors which are removed from the heat exchanger and carried over into the turbine causing corrosion and scaling thereof.

Another object of the present invention is to minimize back-mixing in the geothermal heat exchangers in order to stabilize the transition zone and to additionally prevent the carryover of entrained geothermal brines into the turbine.

Still another object of the present invention is to increase the heat transfer efficiency in the heat exchanger.

Another object is to design a single heat exchanger to replace the plurality of heat exchangers which are presently required in large capacity systems.

SUMMARY OF THE INVENTION

The present invention is directed to overcoming one or more of the problems as set forth above. The invention includes a heat exchanger for the transfer of energy from an elevated temperature fluid including geothermal brines to a working fluid with means for directly contacting the elevated temperature fluid with the working fluid in an interface zone to cause said working fluid to vaporize. Said means further includes means for directing the elevated temperature fluid across the surface of the interface zone to prevent the entrainment of the elevated temperature fluid in the vapor.

Accordingly such an arrangement prevents boil-over or carry-over of entrained elevated temperature liquid in the working fluid vapor which in a preferred embodiment is directed to a turbine. Consequently erosion and scaling of the turbine is minimized or eliminated.

In an aspect of the invention, the directing means includes a distributor plate, means for locating said distributor plate directly above the interface zone, and means for channeling the elevated temperature fluid against said distributor plate to cause the elevated temperature fluid to flow across the surface of the interface zone.

In another aspect of the invention, the directing means includes a plurality of distribution plates, means for locating said distribution plates directly above the interface zone, and means for channeling the elevated temperature fluid against each said distribution plate to cause the elevated temperature fluid to flow across the surface of the interface zone. Further each distribution plate is surrounded by a wall. Such an arrangement can be used to replace multiple heat exchangers by increasing the heat transfer capacity of a single heat exchanger cavity. The elevated temperature fluid impinges against the walls which surround each distribution plate and thereby is caused to swirl, as it is being deentrained, with a resulting increased heat transfer.

In yet another aspect of the invention the heat exchanger includes a wall and the directing means includes a conduit located directly above the transition zone and directed tangentially to said wall.

In yet another aspect of the invention, the directing means includes a channel which defines a plurality of elevated temperature fluid outlet ports and means for locating said channel directly above the interface zone.

In yet another aspect of the invention, straightening vanes are located above the interface zone to prevent the entrainment of the elevated temperature fluid in the vapor, by discharging the elevated temperature fluid from the froth which is formed when the elevated temperature fluid contacts the working fluid.

Although the above invention reduces the amount of back-mixing heretofor associated with prior devices, an additional aspect of the invention includes means for coalescing the working fluid and means for positioning said coalescing means directly beneath the interface zone. This coalescing means additionally prevents back-mixing of the elevated temperature fluid and thereby mitigates instabilities and surges in the level of the operation of the heat exchanger.

In addition to the above, the heat transfer coefficient of the invention is far superior to that of the prior art, allowing for a more efficiently operating boiler.

A further aspect of the invention includes a method of transferring energy from an elevated temperature fluid including geothermal brines to a working fluid which includes the steps of contacting the elevated temperature fluid with the working fluid in an interface zone to cause said working fluid to vaporize and wherein the contacting step includes the step of directing the elevated temperature fluid across the surface of the interface zone to prevent the entrainment of the elevated temperature fluid in the vapor. This method includes all the advantages of the invention as previously indicated hereinabove.

DETAILED DESCRIPTION OF THE PREFERRED EMBODIMENT

Figure 3:
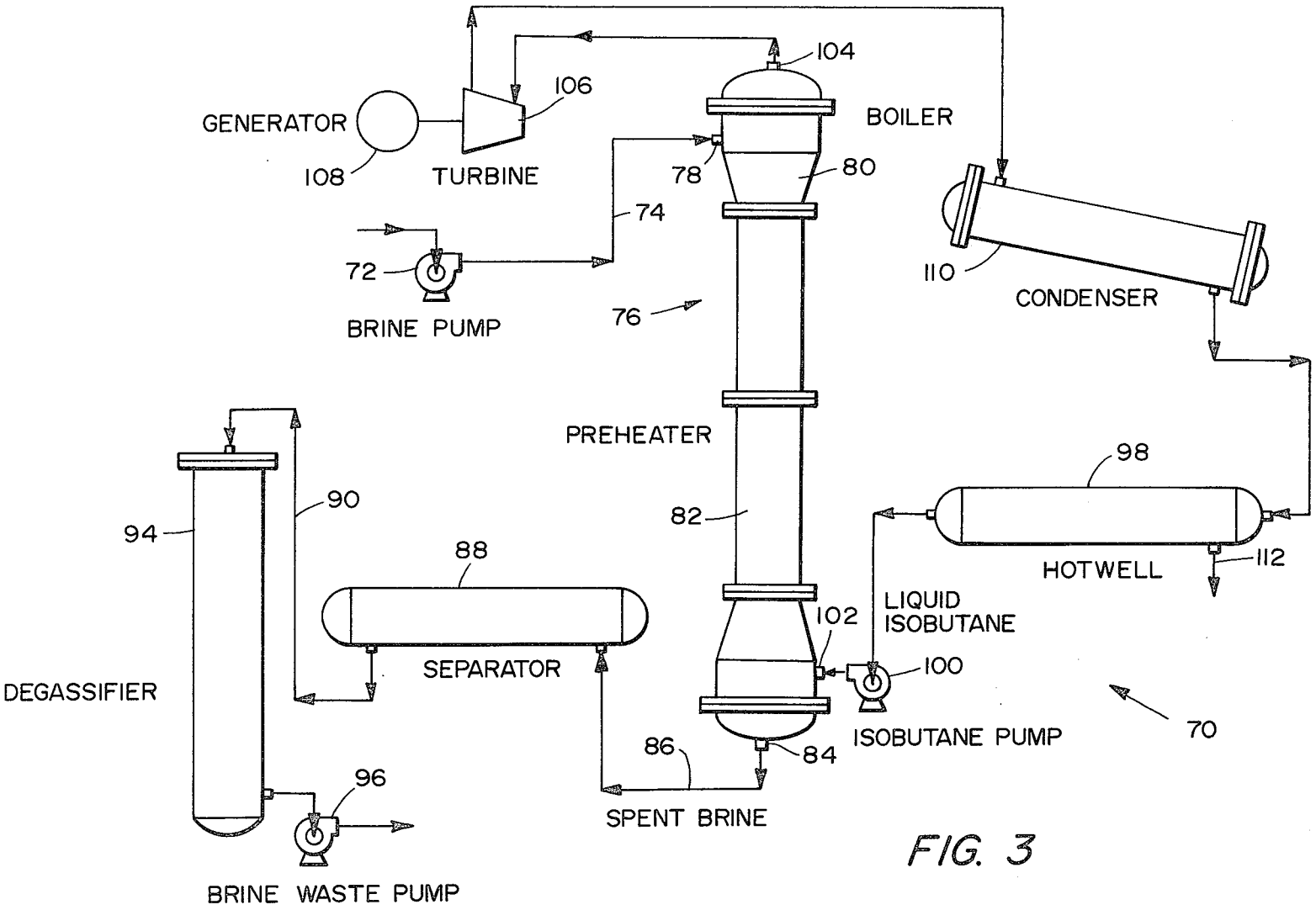
FIG. 3 is a schematic representation of a system including a heat exchanger of the present invention.

With reference to FIG. 3 a system for extracting energy from geothermal brine is depicted and generally denoted by the numeral 70. System 70 includes a source of geothermal brine (not shown) which can include an underground deposit of water which is maintained in a heated state by the earth's magma. For purposes of understanding the invention, an example of operating pressures, temperatures and flow rates will be indicated in the discussion of the system of FIG. 3. It is to be understood that the system can be operated at other temperatures and pressures. The geothermal brine source is tapped and delivered to a brine pump 72 at 335° F. and 118.0 psia with a flow rate of $97.2\times10^3$ lbs./hr. From the brine pump the geothermal brine is delivered through conduit 74 to heat exchanger vessel 76 through port 78 at 335° F. and 485 psia and with a flow rate of $97.2\times10^3$ lbs./hr. Heat exchanger vessel 76 includes an upper portion which defines a boiler 80 and a lower portion which defines a preheater 82, both of which will be discussed in more detail hereinbelow.

In heat exchanger vessel 76 the geothermal brine mixes with system isobutane as will be more fully described hereinbelow and exits through port 84 located at the bottom of preheater 82. The spent brine exiting at port 84 is at a temperature of 148.8° F. with a pressure of 457 psia and a flow rate of approximately $95.8\times10^3$ lbs./hr.

The spent brine is directed by conduit 86 to a separator 88 at 148.8° F. and 457 psia with a flow rate of $95.8\times10^3$ lbs./hr. In the isobutane carried under or entrained in the brine during its trip through the preheater 82 is removed and returned to the system for recycling by conduits (not shown).

The brine from separator 88 flows through conduit 90 into degassified oil recovery flash tank 94 where any remaining isobutane, dissolved in the brine, is removed. The brine leaves degassifier 94 at approximately 144.8° F., 5 psia and at a flow rate of $95.8\times10^3$ lbs./hr. The brine goes through a waste brine pump 96 where it increases in pressure to 20 psia. From the brine waste pump, the brine can be fed to an additional apparatus (not shown) in preparation for reinjecting the brine into a reinjection well.

In this embodiment the working fluid which is mixed with the brine to extract energy therefrom is isobutane. However, it should be understood that other immiscible working fluids such as methane, ethane, propane, n-butane, n-pentane, isopentane and neopentane and other analogous olefins and mixtures thereof can be substituted for the isobutane. Additionally fluorocarbons can be used.

The isobutane loop of the system 70 is as follows, and it is to be understood that in this embodiment the flow rate of isobutane is substantially equivalent to that of the geothermal brine. The isobutane is stored in a hot well 98. The isobutane leaves hot well 98 in liquid form at a temperature of 94° F., a pressure of 72 psia and a flow rate of $98.0\times10^3$ lbs./hr. The isobutane is provided to an isobutane pump 100 and therefrom delivered through port 102 (FIG. 4) to the lower end of preheater 82. The liquid isobutane is delivered to preheater 82 at 95° F. and 485 psia at a flow rate of $98.0\times10^3$ lbs./hr. As will be discussed more fully hereinbelow the isobutane mixes with the geothermal brine and vaporizes in boiler 80 of the heat exchanger vessel 76. The vaporized isobutane including $1.4\times10^3$ lbs./hr. of steam leaves vessel 76 through port 104 at the upper end thereof at a temperature of 255° C., a pressure of 452.7 psia, and a flow rate of $99.4\times10^3$ lbs./hr. and proceeds to turbine 106 where the vapors expand, driving turbine 106 to drive electrical generator 108. The vapors leave turbine 106 at a temperature of about 140.6° F., a pressure of 72.0 psia and a flow rate of $99.4\times10^3$ lbs./hr., and are delivered to condenser 110 where the vapor is condensed. The isobutane leaves the condenser at a temperature of 94° F., a pressure of 70 psia with a flow rate of $99.4\times10^3$ lbs./hr. and returns to hot well 98. About $1.4\times10^3$ lbs./hr. of water condensate formed in the hot well 98 is continuously drained through drain 112.

Figure 4:
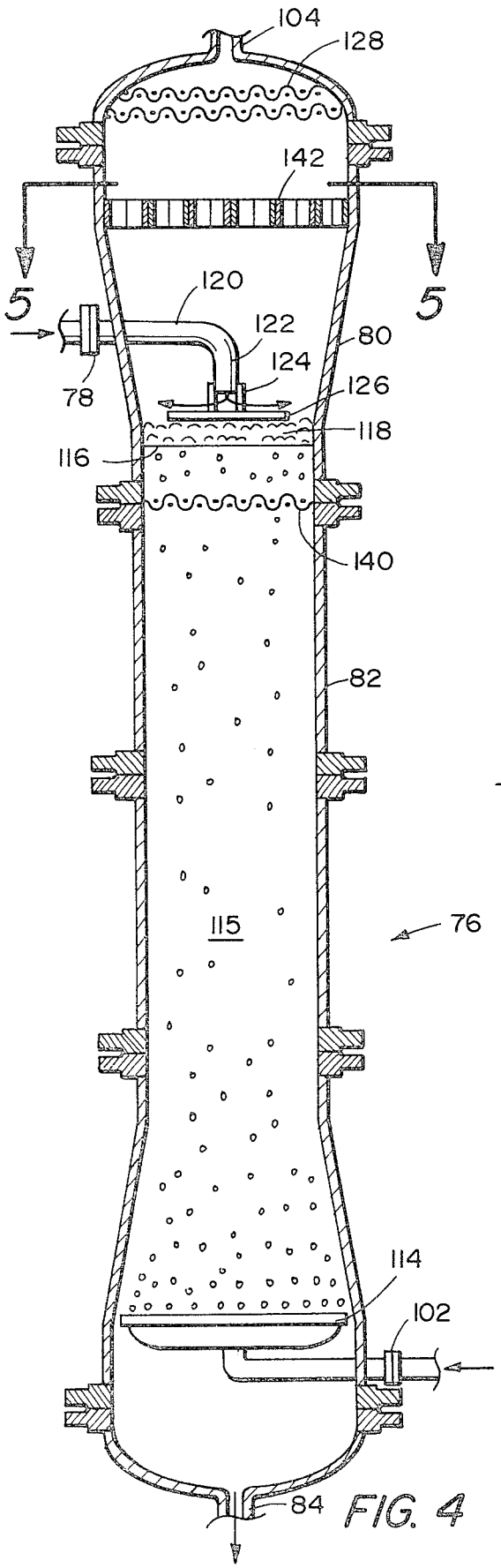
FIG. 4 is a cross-sectional elevation view of the heat exchanger of the invention as used in FIG. 3.

Turning to FIG. 4 a partially cross-sectional view of heat exchanger vessel 76 is depicted. As previously noted isobutane enters vessel 76 at port 102 and enters a distributor 114. The distributor dispenses liquid isobutane isobutane therefrom in the form of working fluid droplets. As the isobutane has a lower specific gravity than the geothermal brine, a stream of working fluid droplets rise from the bottom of vessel 76 upwardly along preheater 82, in a column 115 of brine that is contained in preheater 82. The down-flowing brine preheats the isobutane droplets as they rise upwardly toward the boiler 80.

The isobutane finally reaches level 116, the top of the brine-continuous zone, which essentially marks the end of the preheater 82 and the beginning of boiler 80. Above the isobutane film 116 is a transitional zone 118 which comprises a foamy, frothy and emulsified mixture of liquid and vaporized isobutane and geothermal brine.

The geothermal brine as previously described enters vessel 76 through port 78 and is directed by a conduit 120 downwardly toward the transitional zone 118. As can be seen in FIG. 4 conduit 120 extends radially inwardly and axially downwardly towards transition zone 118 to provide a stream of geothermal brine which is substantially perpendicular to said transitional zone 118. Secured to the discharge end 122 of conduit 122 by appropriate mounting bars 124 is a brine distributor plate 126. Distributor plate 126 is essentially disk shaped in a preferred embodiment and is spaced immediately below discharge end 122 of conduit 120 and just above the top of transition zone 118. The geothermal brine dispensed from discharge end 122 impinges on plate 126 and the flow of brine changes direction from a longitudinally and downward direction to an outwardly and radial direction immediately above transition zone 118. The geothermal brine has been measured in a preferred embodiment to have a velocity of approximately 30 feet per second as it heads radially outwardly. The geothermal brine impinges against the conical side wall of vessel 76, and at least adjacent said side wall, establishes a swirling motion. The outwardly radial motion and the swirling motion atomizes the isobutane and disburses the foamy upper surface of the transition zone 118 to control the location of said upper surface. As the sides of the vessel act as guides to cause the brine to swirl, liquid droplets of isobutane and brine which would otherwise be entrained in the rising vapors, coalesce. Thus by acting as a foam and froth breaker, the brine prevents excessive carry over of geothermal brine with the vaporized isobutane into the turbine 106.

Approximately 7 to 10 percent of the brine distributed by plate 126 flashes to steam. Approximately 90 percent of this steam condenses to vaporize the isobutane. The equilibrium vapor consequently contains about 1.4% by weight of steam and 98.6% isobutane by weight.

Nearly one hundred percent of the isobutane vaporizes with a minimal amount of brine carry-over mist entrained therein. This is in sharp contrast to the prior art embodiments of FIGS. 1 and 2 wherein a goodly amount of geothermal brine is entrained in the vaporized isobutane. As previously discussed this entrainment leads to severe corrosion and mineral buildup problems in turbine 106. In the preferred embodiment, the equilibrium temperature of the brine in the transitional zone is approximately 255° F. at a pressure of approximately 453 psia. The isobutane is at this temperature superheated to about 5° above its normal boiling point of approximately 250° F. at this total pressure. At this superheated temperature, however, the brine has flashed down to its saturated vapor pressure of 32.55 psia.

Figure 1:
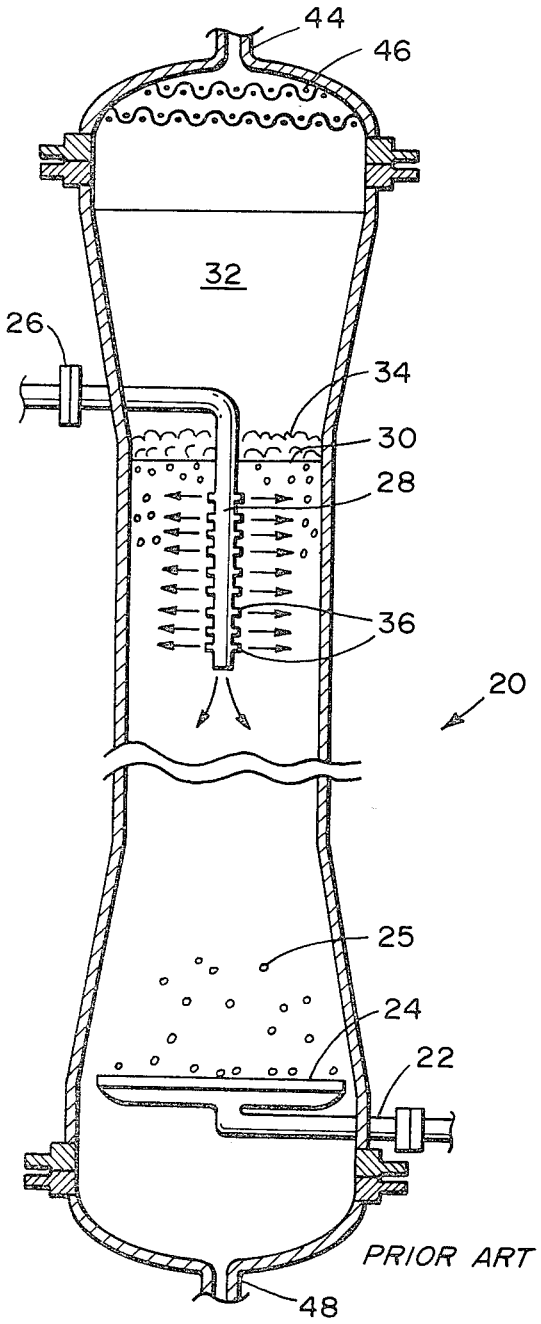
FIG. 1 is a cross-sectional elevation view of an embodiment of a prior art heat exchanger.
Figure 2:
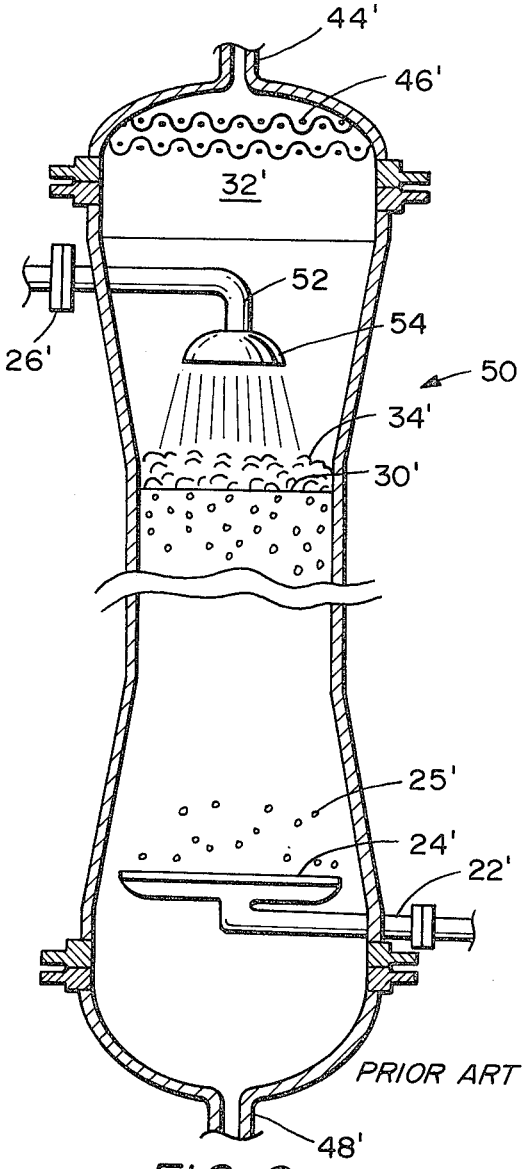
FIG. 2 is a cross-sectional elevation view of another embodiment of a prior art heat exchanger.
Figure 1A:
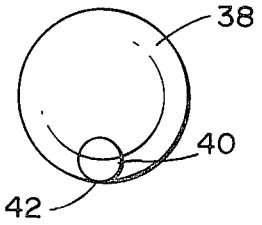
FIG. 1A is a representation of a liquid droplet of isobutane surrounded by a vaporous isobutane blanket.

Because this direct contact heat exchange proceeds simultaneously by liquid-liquid transfer and by dropwise condensation of steam upon small evaporating isobutane droplets, it has a volumetric heat transfer coefficient of at least four times that of the coefficients for the prior embodiments FIGS. 1 and 2. Accordingly as the heat transfer coefficient is far superior to that of the prior art embodiment, the design of the present invention can be much smaller than the prior art embodiments to accomplish the same amount of heat transfer.

The vaporized isobutane, about 1.4% by weight of water vapor, and any remaining entrained geothermal brine in either a liquid or vapor phase flows upwardly in boiler 80 until it reaches demister 128. In a preferred embodiment demister 128 can include a woven, stainless steel mesh. The demister 128 acts as a disengagement means and blocks the passage of the entrained liquid isobutane that has not heretofor vaporized and the entrained liquid geothermal brine. The geothermal brine mist coalesces on the demister 128. Liquid brine and isobutane drops back to the preheater. The pressure drop across the demister is minimal and the isobutane leaving boiler 80 through port 104 is at approximately 255° F. and 452.7 psia. The isobutane is at this point is a superheated, mist free vapor which is most advantageous for the operation of turbine 106.

Accordingly the invention increases the heat transfer coefficient and thus reduces the size of a boiler for a given energy transfer. Further the invention reduces and prevents liquid and mist brine carry-over to the turbine with associated corrosion and scaling. Finally as the brine is not introduced directly into the preheater column of isobutane and geothermal brine, as in the prior art device in FIG. 1, the invention minimizes back mixing of the geothermal brine in the preheater and thus minimizes waves, turbulence and associated instabilities in the preheater 82.

The operation of the heat exchange of the invention is as is described hereinabove. Further, with respect to FIG. 4 at subcritical temperatures for the isobutane or other hydrocarbons, the transition zone 118 comprises a three-phase frothy mixture of two immiscible liquid phases plus a common gas phase wherein boiling occurs at a constant temperature.

At supercritical temperatures, however, the liquid hydrocarbon phase vanishes and the transition zone now comprises only a two-phase mixture of a brine liquid phase plus a common gas phase consisting of a steam and supercritical hydrocarbon fluid mixture. Boiling comprises essentially superheating the supercritical hydrocarbon fluid simultaneously by direct contact with the live steam of the flashing brine and with hot brine spray.

The invention has therefore at supercritical temperatures advantages over prior art similar to those at subcritical temperatures, plus an advantage that the transition zone now becomes a very effective superheating zone occupying a minimal volume which can be used either to reduce the size and cost of the equipment or to leave a greater volume or freeboard available for the demisting in the gas-continuous zone above the transition zone 118.

The superheating zone also provides a much closer approach of the temperature of the hydrocarbon working fluid to that of the geothermal brine source than does a constant boiling temperature zone with a subsequently higher resource utilization factor (energy extracted by the isobutane from the brine divided by the total energy of the brine) for extraction of geothermal power.

As a modification of the invention, a screen 140 is submerged in the geothermal brine and isobutane mixture of the preheater 82. The screen is placed directly below the level 116 and in a preferred embodiment is oil wettable or oleophilic. The screen can be composed of, for example, silicone or teflon and serves to assist in coalescing the isobutane droplets as they flow upwardly and assists in forming and stabilizing the position of an isobutane film at level 116. Further the olephilic screen prevents turbulent action from boiler section 80 and transitional zone 118 from propagating downwardly into preheater 82 and causing back-mixing which is inherent in the prior art embodiment of FIG. 1. Such back-mixing can disturb the position of the top of the brine-continuous zone at level 116 causing brine to carry over to the turbine and thus disturb the orderly and stable operation of heat exchanger 76. Further the oleophilic screen allows a uniform distribution of brine to flow downwardly.

Figure 5:
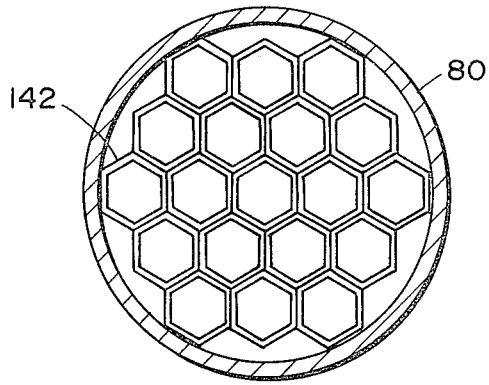
FIG. 5 is a cross-sectional view looking in the direction of arrows 5—5 in FIG. 4.

A further improvement of the above invention lies in the placement of vertical straightening vanes 142 (FIGS. 4 and 5) in the vapor-continuous zone of the boiler 80 between the distributor 126 and the demister 128. Vertical straightening vanes 142 comprise in the preferred embodiment vertical hexagonal cells which are distributed horizontally across the boiler but without inhibiting the upward movement of isobutane vapors therethrough. The vertical straightening vanes 142 act as an disengagement means or froth breaker for the froth and entrained geothermal brine which can flow upwardly toward port 104 along with the isobutane vapor, at a rate of approximately one foot/second in a preferred embodiment, under turbulent boiling conditions. The straightening vanes 142 act in much the same way that the demister 128 does. As vanes 142 break any foam and froth, they act as a safeguard to return droplets of geothermal brine to the preheater without the loss of pressure to the turbine. Thus the vertical straightening vanes 142 act as a backup mechanism for the demister 128 and in particular for startup and other temporary upset conditions to remove entrained geothermal brine and to prevent possibly overloading and flooding of the demister 128. It is to be understood that vertical vanes other than hexagonal vanes 142 can be used. As for example, vertical circular vanes and vanes forming a square matrix grid can also be used.

Figure 6:
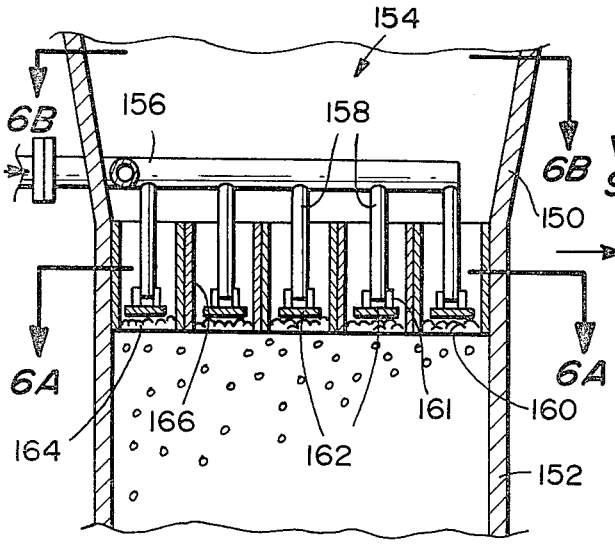
FIG. 6 is a portion of an alternate embodiment of the heat exchanger of the invention.
Figure 6B:
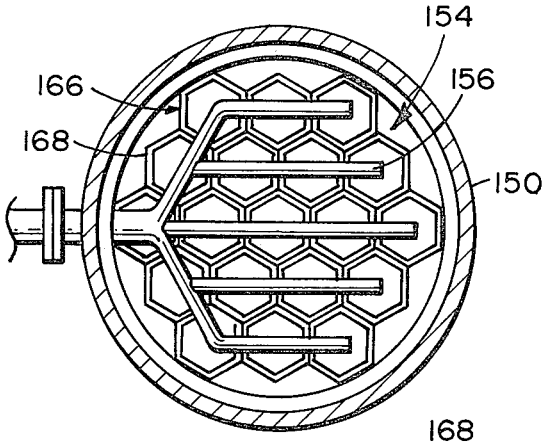
FIG. 6B is a cross-sectional view looking in the direction of arrows 6B—6B in FIG. 6.
Figure 6A:
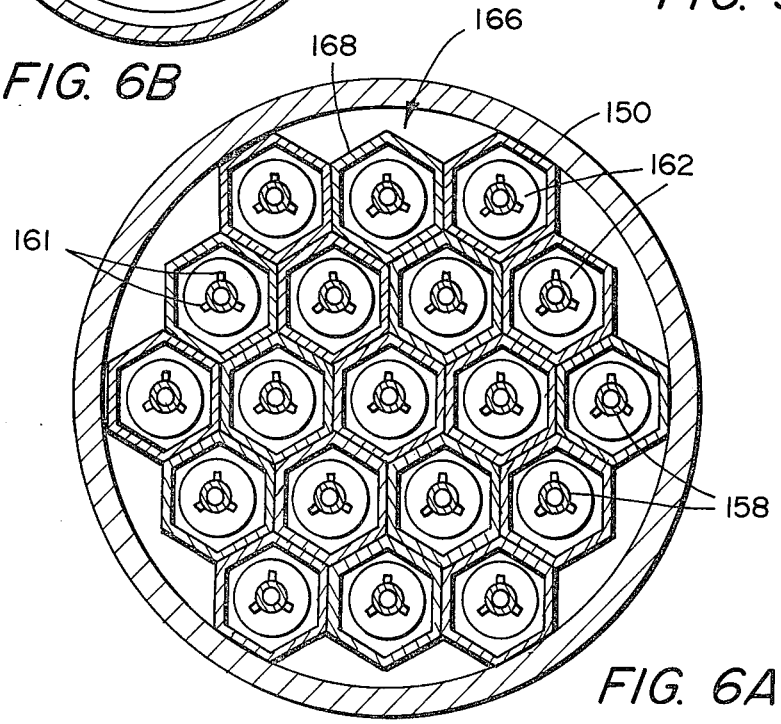
FIG. 6A is a cross-sectional view taken through line 6A—6A of FIG. 6.

Still an alternate embodiment of the invention is depicted in FIGS. 6, 6A and 6B. In this embodiment the boiler section of the preheater is identified with the numeral 150 and the preheater is identified with the numeral 152. The boiler includes a modified brine distributer 154 which includes a distribution manifold 156 (FIG. 6B) which has a plurality of downwardly dependent distribution conduits 158. The distribution conduits 158 direct geothermal brine downwardly toward transitional zone 164 and the top of the brine-continuous zone at level 160. Directly beneath and affixed to each distribution conduit by mounting bars 161 is a distribution plate 162 which is similar in design and purpose to distribution plate 126 of the embodiment of FIG. 4. Surrounding each distribution plate 162 and distributor conduit 158 and partly submerged in the froth and foam transitional zone 164 immediately above level 160 is an impingement arrangement 166. Impingement arrangement 166 includes a plurality of vertically disposed, hexagonal shape cells which surround each of the distribution conduits 158 and distribution plates 162. The impingement arrangement 166 essentially provides for many distribution arrangements such as the single distribution arrangement of conduit 120 and distribution plate 126 fully described in conjunction with FIG. 4. Briefly stated, each distribution plate 162 causes geothermal brine to be directed radially outwardly toward and impinged upon the walls of impingement arrangement 166. This outward radial flow of the geothermal brine causes the foam and froth created in the transitional zone 164 to disburse. The impingement of the brine against the walls of the impingement arrangement 166 causes some of the brine to swirl about in the vapor-continuous zone above zone 164 and also assists in disbursing the foam and froth and in preventing entrainment of geothermal brine in the evaporating isobutane. With such an arrangement, as depicted in FIG. 6, highly efficient heat exchange can be fabricated without having to provide for a plurality of parallel heat exchangers as would be necessary with prior art devices. Thus, such an arrangement drastically reduces the cost for a heat exchanger for such a geothermal system.

Figure 7:
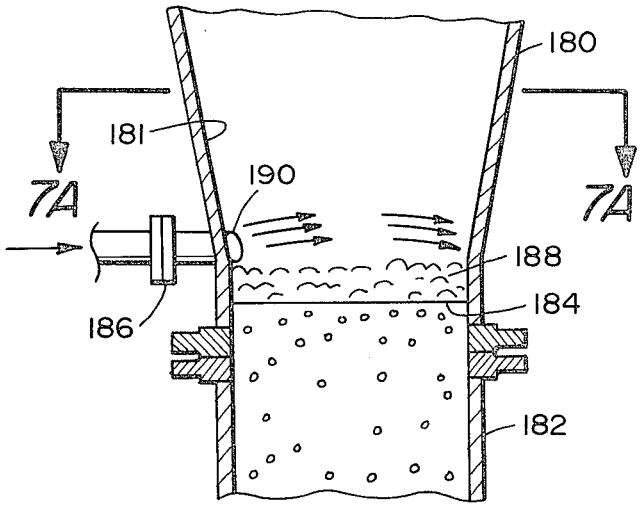
FIG. 7 is another alternate embodiment of the heat exchanger of the invention.
Figure 7A:
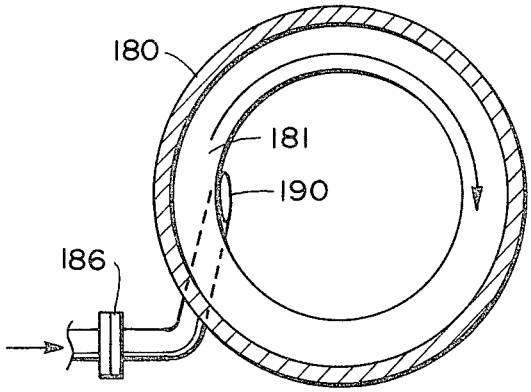
FIG. 7A is a cross-sectional view looking in the direction of arrows 7A—7A in FIG. 7.

Yet another alternate embodiment of the invention can be seen in FIGS. 7 and 7A. In FIG. 7, the boiler section is denoted by the numeral 180 and the preheater section by the numeral 182 with the top of the brine-continuous zone as level denoted 184. The brine is introduced through port 186 immediately above the interface zone 188 which includes the aforementioned frothy mixture of isobutane and geothermal brine positioned immediately above the level 184. Extending from port 186 is a distribution conduit 190 which enters the boiler 180 substantially tangentially to the somewhat conical wall 181 thereof. Accordingly the distribution conduit 190 directs geothermal brine tangentially to the walls of the boiler 180 and causes said brine to swirl about the boiler 180 immediately above the transitional zone 188. Such action provides good contact between the geothermal brine and the isobutane, atomizing said isobutane and causing it to vaporize as described hereinabove with relation to FIG. 4. Further the swirling action of the geothermal brine causes the foam to disburse and thus helps retard the entrainment of geothermal brine in the vaporized isobutane. Such an arrangement increases the vapor space in the boiler. Further this arrangement allows the brine to be introduced at the transitional zone 188 without spraying such brine from above, as in the prior art embodiment of FIG. 2, which has the effect of minimizing turbulences in the boiler.

Figure 8:
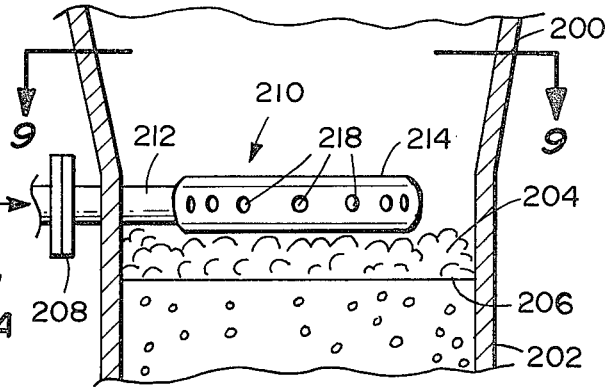
FIG. 8 is a portion of a cross-sectional elevation view of yet another embodiment of the heat exchanger of the invention.
Figure 9:
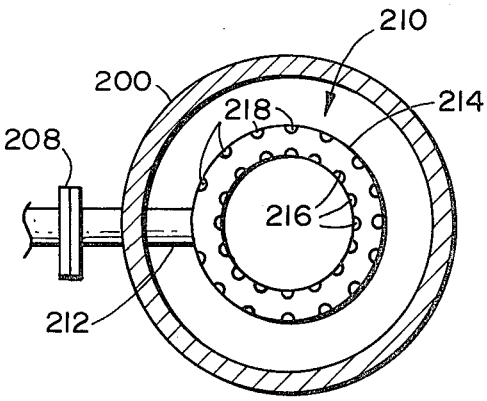
FIG. 9 is a cross-sectional view looking in the direction of arrows 9—9 in FIG. 8.

Still a further embodiment of the invention can be found in FIGS. 8 and 9. In FIG. 8, the boiler is identified by the numeral 200, the preheater by the numeral 202, the transitional zone by the numeral 204 and the top of the brine-continuous zone by 206. A port 208 allows the introduction of geothermal brine into boiler section 200. Secured to port 208 is a distributor arrangement 210 which is disposed immediately above the transitional zone 204. Distributor 210 includes a distributor conduit 212 which is secured to port 208 and an annulus 214 which is in fluid communication with conduit 212. Annulus 214 defines a plurality of ports 216 directed inwardly along the radii of annulus 214. Further additional plurality of ports 218 are directed outwardly along radii of annulus 214.

The outwardly directed geothermal brine from ports 218 is directed immediately above the transitional zone and thus assists in breaking the froth and foam of the transitional zone and preventing the entrainment of geothermal brine in the vaporized isobutane. Additionally as this geothermal brine impinges upon the internal wall of the boiler 200, a swirling action is maintained which assists in the breaking of the froth and foam, preventing brine entrainment, and in the atomization of the isobutane and the subsequent vaporization thereof as in the case of the other embodiments of the invention. The inwardly directed geothermal brine from ports 216 additionally assists in the break up of the froth and foam and in the prevention of brine entrainment.

Other aspects, objects and advantages of this invention can be obtained from a study of the drawings, the disclosure, and the appended claims.

I claim:

1. A heat exchanger for the transfer of energy from an elevated temperature fluid including geothermal brines to a working fluid flowing in a specified direction comprising:

means for directly contacting the elevated temperature fluid with the working fluid in a transitional zone to cause said working fluid to vaporize; and which means located closely adjacent to the transitional zone include means for directing the elevated temperature fluid across the surface of the transitional zone in a direction substantially transverse to said specified direction to prevent the entrainment of the elevated temperature fluid in the vapor of the working fluid.

2. The apparatus of claim 1 wherein the directing means includes:

a distributor plate;

means for locating said distributor plate adjacent the transitional zone;

means for channeling the elevated temperature fluid against said distributor plate to cause the elevated temperature fluid to flow across the surface of the transitional zone.

3. The apparatus of claim 1 wherein the heat exchanger includes a wall; and wherein said directing means includes:

a distributor plate;

means for locating said distributor plate adjacent the transitional zone and at least partially surrounded by said wall of the heat exchanger;

means for channeling the elevated temperature fluid against said distributor plate to cause the elevated temperature fluid to flow across the surface of the transitional zone and strike said wall.

4. The apparatus of claim 1 wherein the directing means includes:

a plurality of distributor plates;

means for locating said distributor plates adjacent the transitional zone;

means for channeling the elevated temperature fluid against each said distributor plate to cause the elevated temperature fluid to flow across the surface of the transitional zone.

5. The apparatus of claim 1 wherein the directing means includes:

a plurality of distributor plates;

means for locating said distributor plates adjacent the transitional zone;

means defining a wall at least partially surrounding each distributor plate;

means for channeling the elevated temperature fluid against each distributor plate to cause the elevated temperature fluid to flow across the surface of the transitional zone and impinge against the surrounding wall.

6. The apparatus of claim 1 wherein said heat exchanger includes a wall; and wherein said directing means includes a conduit with an elevated temperature fluid outlet located adjacent the transition zone, and directed tangentially to said wall.

7. The apparatus of claim 1 wherein said directing means includes a channel which defines a plurality of elevated temperature fluid outlet ports and means for locating said channel directly above the transitional zone.

8. A method for transferring energy from an elevated temperature fluid including geothermal brines to a working fluid including the steps of:

contacting the elevated temperature fluid with the working fluid in a transitional zone to cause said working fluid flowing in a first direction to vaporize; and wherein said contacting step includes the step of:

directing the elevated temperature fluid across the surface of the transitional zone in a direction substantially transverse to said first direction to prevent the entrainment of the elevated temperature fluid in the vapor.

9. The method of claim 8 including the steps of:

providing a distributor directly above the transitional zone; and channeling the elevated temperature fluid to said distributor to cause the elevated temperature fluid to flow across the surface of the transitional zone.

10. The method of claim 9 including the steps of:

providing a wall about said distributor; and impinging the elevated temperature fluid from the distributor against the wall.

11. The method of claim 8 wherein said directing step includes:

impinging the elevated temperature fluid against a cylindrical wall of the heat exchanger by directing said fluid tangentially to said wall.

12. A heat exchanger for the recovery of energy from elevated temperature or hot water containing fluids including geothermal brines and other elevated temperature water sources comprising:

means for directly contacting the elevated temperature fluid with a working fluid flowing in a first direction in a transitional zone to cause said working fluid to vaporize; and which means includes means for directing the elevated temperature fluid in a swirling motion across the surface of the transitional zone in a direction substantially transverse to said first direction to prevent the entrainment of the elevated temperature fluid in the vapor of the working fluid.

13. The apparatus of claim 12 wherein the directing means includes:

a distributor plate;

means for locating said distributor plate adjacent the transitional zone;

means for channeling the elevated temperature fluid against said distributor plate to cause the elevated temperature fluid to flow across the surface to the transitional zone.

14. The apparatus of claim 12 wherein said heat exchanger includes a wall; and wherein said directing means includes a conduit with an elevated temperature fluid outlet directed tangentially to said wall and positioned adjacent said transitional zone.

15. A heat exchanger for the transfer of energy from an elevated temperature fluid including geothermal brines to a working fluid comprising:

means for directly contacting the elevated temperature fluid with the working fluid in a transitional zone to cause said working fluid to vaporize; and which means includes means for directing the elevated temperature fluid across the surface of the transitional zone to prevent the entrainment of the elevated temperature fluid in the vapor of the working fluid, said directing means including:

at least one distributor plate;

means for locating said at least one distributor plate adjacent the transitional zone; and means for channeling the elevated temperature fluid against said at least one distributor plate to cause the elevated temperature fluid to flow across the surface of the transitional zone.

16. The apparatus of claim 2 or 15 wherein said channeling means directs elevated temperature fluid substantially perpendicularly against said distributor plate and wherein said distributor plate is substantially parallel with the transitional zone.

17. The apparatus of claim 1 or 15 including means, located above said transitional zone, for preventing the entrainment of the elevated temperature fluid in the working fluid vapor by discharging any entrained elevated temperature fluid.

18. The apparatus of claim 17 wherein said entrainment preventing means includes a plurality of parallel channels.

19. The apparatus of claim 17 including a demister located above the entrainment preventing means to also prevent the entrainment of the elevated temperature fluid in the vapor.

20. The apparatus of claim 1 or 15 including means for coalescing the working fluid and means for positioning the coalescing means adjacent said transitional zone.

21. The apparatus of claim 20 wherein said coalescing means includes an oleophilic screen.

22. The apparatus of claim 1 or 15 wherein said heat exchanger includes a boiler section and a preheater section separated by said transitional zone; wherein said directly contacting means is located in said boiler section; the apparatus including means for introducing the working fluid into said preheating section; and wherein said fluid introduction means include means for disbursing said working fluid in droplets, the apparatus further including means for coalescing the droplets and means for positioning the coalescing means directly beneath said transitional zone.

23. The apparatus of claim 1 or 15 wherein the working fluid has a specific gravity which is less than the specific gravity of said elevated temperature fluid and wherein said working fluid is immiscible with said elevated temperature fluid.

24. The apparatus of claim 1 or 15 wherein said working fluid has a lower boiling point than said elevated temperature fluid.

25. The apparatus of claim 1 or 15 including a preheater for preheating said working fluid which preheater is adjacent said transitional zone and including means for preventing turbulent back-mixing of the elevated temperature fluid and the working fluid in said preheater.

26. A method for transferring energy from an elevated temperature fluid including geothermal brines to a working fluid including the steps of:

contacting the elevated temperature fluid with the working fluid in a transitional zone to cause said working fluid to vaporize; said contacting step includes the step of:

directing the elevated temperature fluid across the surface of the transitional zone to prevent the entrainment of the elevated temperature fluid in the vapor; said directing step includes the steps of:

providing at least one distributor directly above the transitional zone, and channeling the elevated temperature fluid to said at least one distributor to cause the elevated temperature fluid to flow across the surface of the transitional zone;

providing a wall about said at least one distributor; and impinging the elevated temperature fluid from the at least one distributor against the wall.

27. The method of claim 21 or 26 including the steps of:

preventing the entrainment of the elevated temperature fluid in the vapor by also providing straightening vanes above said transitional zone.

28. The method of claim 21 or 26 including the step of coalescing the working fluid adjacent said transitional zone.

29. The method of claim 28 wherein said coalescing step includes providing a screen adjacent said transitional zone.

30. The method of claim 28 wherein said coalescing step includes:

providing an oleophilic screen adjacent said interface zone.

31. The method of claim 21 or 26 wherein said directing step includes:

swirling the elevated temperature fluid across the surface of the transitional zone to prevent the entrainment of the elevated temperature fluid in the vapor.

* * * * *